US006899639B2

(12) United States Patent
Simonutti et al.

(10) Patent No.: US 6,899,639 B2
(45) Date of Patent: May 31, 2005

(54) TWO PIECE BALANCED GOLF BALL

(75) Inventors: Frank M. Simonutti, Jackson, TN (US); Wayne R. Bradley, Trenton, TN (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/226,003

(22) Filed: Aug. 22, 2002

(65) Prior Publication Data

US 2004/0038751 A1 Feb. 26, 2004

(51) Int. Cl.[7] ..... A63B 37/02; A63B 39/00; A63B 37/04; A63B 37/06

(52) U.S. Cl. ..... 473/352; 473/377

(58) Field of Search ..... 473/351–378

(56) References Cited

U.S. PATENT DOCUMENTS

| | | | | | |
|---|---|---|---|---|---|
| 2,259,060 | A | | 10/1941 | Brown | |
| 2,741,480 | A | | 4/1956 | Elyria | |
| 4,442,282 | A | | 4/1984 | Kolycheck | 528/83 |
| 4,984,804 | A | | 1/1991 | Yamada et al. | 524/908 |
| 5,150,906 | A | * | 9/1992 | Molitor et al. | 473/354 |
| 5,222,739 | A | | 6/1993 | Horiuchi et al. | |
| 5,314,187 | A | | 5/1994 | Proudfit | |
| 5,480,155 | A | * | 1/1996 | Molitor et al. | 473/354 |
| 5,497,996 | A | | 3/1996 | Cadorniga | |
| 5,543,467 | A | * | 8/1996 | Hamada et al. | 525/207 |
| 5,589,546 | A | | 12/1996 | Hiraoka et al. | 525/193 |
| 5,605,968 | A | | 2/1997 | Egashira et al. | 525/221 |
| 5,752,889 | A | * | 5/1998 | Yamagishi et al. | 473/377 |
| 5,779,561 | A | | 7/1998 | Sullivan et al. | 473/373 |
| 5,779,563 | A | * | 7/1998 | Yamagishi et al. | 473/371 |
| 5,782,707 | A | | 7/1998 | Yamagishi et al. | 473/374 |
| 5,795,247 | A | | 8/1998 | Yokota et al. | 473/374 |
| 5,807,192 | A | * | 9/1998 | Yamagishi et al. | 473/377 |
| 5,846,142 | A | * | 12/1998 | Kakiuchi et al. | 473/354 |
| 5,929,189 | A | | 7/1999 | Ichikawa et al. | 528/76 |
| 5,935,022 | A | | 8/1999 | Sugimoto et al. | 473/373 |
| 5,971,871 | A | | 10/1999 | Sullivan et al. | 473/373 |
| 5,984,806 | A | | 11/1999 | Sullivan et al. | 473/373 |
| 5,998,506 | A | | 12/1999 | Nesbitt | 523/219 |
| 6,010,412 | A | | 1/2000 | Moriyama | 473/373 |
| 6,015,351 | A | | 1/2000 | Elcock et al. | 470/10 |
| 6,045,461 | A | | 4/2000 | Yamagishi et al. | 473/377 |
| 6,106,415 | A | | 8/2000 | Masutani et al. | 473/374 |
| 6,114,455 | A | * | 9/2000 | Dalton | 525/221 |
| 6,129,640 | A | | 10/2000 | Higuchi et al. | 473/374 |
| 6,142,888 | A | | 11/2000 | Higuchi et al. | 473/374 |
| 6,152,836 | A | | 11/2000 | Bradley et al. | 473/378 |
| 6,156,843 | A | | 12/2000 | Yokota | 525/221 |
| 6,210,293 | B1 | | 4/2001 | Sullivan | 473/374 |
| 6,213,894 | B1 | | 4/2001 | Sullivan et al. | 473/374 |
| 6,244,978 | B1 | * | 6/2001 | Higuchi et al. | 473/374 |
| 6,261,193 | B1 | | 7/2001 | Sullivan et al. | 473/377 |
| 6,270,428 | B1 | | 8/2001 | Kuttappa | 473/367 |
| 6,315,681 | B1 | | 11/2001 | Sullivan | 473/373 |
| 6,315,682 | B1 | | 11/2001 | Iwami et al. | 473/374 |
| 6,319,152 | B1 | * | 11/2001 | Takesue et al. | 473/371 |

FOREIGN PATENT DOCUMENTS

| | | |
|---|---|---|
| EP | 1 084 736 | 8/2000 |

OTHER PUBLICATIONS

Farrally et al., Science and Golf III, Proceedings of the 1998 World Scientific Congress of Golf. Illinios: Human Kinectics, copyright 1999, pp. 411–413.*

* cited by examiner

*Primary Examiner*—Gregory Vidovich
*Assistant Examiner*—Alvin A. Hunter, Jr.
(74) *Attorney, Agent, or Firm*—Terence P. O'Brien

(57) ABSTRACT

A golf ball includes a core and a cover layer. The core is formed of a first composition and the cover is formed of a second composition. The specific gravity values of each of the first and second compositions are generally equal to each other. The first and second compositions are each sufficiently mixed such that the ball exhibits random orientation when floated in a solution of sufficient density to support the ball. The weight, size, spherical symmetry, initial velocity and overall distance of the ball conform to the requirements of the United States Golf Association.

4 Claims, 2 Drawing Sheets

TWO PIECE BALANCED GOLF BALL

FIELD OF THE INVENTION

The present invention relates generally to a two-piece, balanced golf ball. In particular, the present invention relates to a balanced two-piece golf ball wherein the two pieces are formed of separate compositions, which have substantially the same specific gravity.

BACKGROUND OF THE INVENTION

Golf balls are well known sporting goods articles that have evolved over the years. Golf balls made prior to the late 1960's typically included a rubber center, a layer of thread rubber windings surrounding the center to form a wound core, and a rubber cover that covered the wound core. The cover was typically formed of a balata rubber (transpolyisoprene, natural or synthetic rubbers). In the late 1960's, DuPont® introduced ionomers under the trade name Surlyn®. Ionomers, such as Surlyn® and related products, such as Iotek® produced by Exxon® Corporation, have been used as a cover material for the majority of golf balls produced since the late 1960's. The use of ionomers in the production of golf ball covers led the way to the development of "two-piece" golf balls, which comprise a solid core and a cover. More recently, thermoplastic and thermoset (castable) polyurethanes have been utilized in the formation of golf ball covers, including golf balls with wound or solid cores. The use of these materials has also led to the proliferation of many multi-layer solid core golf ball constructions wherein two or more layers are applied over a solid core.

Existing two-piece, and multi-layer, golf balls have some drawbacks. All of the various materials used in the construction of golf balls, from wound core constructions through to multi-layer solid core constructions, have varying densities. Accordingly, the mass or weight per unit volume of these materials varies. For example, typically, the materials used to produce the cover layer often possess a greater weight or mass per unit volume than the materials used to produce the core. Additionally, the material composition of most intermediate layers has a density or a weight per unit volume that is different than the density or weight per unit volume of the core and/or the cover layer. If a golf ball is manufactured perfectly, that is if the core or center of a ball is centered exactly, and if the cover layer thickness, and intermediate layer thickness (if applicable), are constant throughout the entire ball, the ball will be "balanced", and should fly true when struck with a golf club, or should roll true when putted.

However, in the manufacturing of a golf ball, it is very difficult to ensure that a core of the golf ball is exactly and perfectly centered within the ball. Moreover, it is also very difficult to ensure that the thickness of the cover layer, and the thickness of the intermediate layer(s) of multi-piece balls, are uniform and consistent about the periphery of the core. Further, it is also difficult to ensure that the materials comprising the cover layer, and the intermediate layer (if applicable), are properly and sufficiently mixed or homogenized such that the composition and density of the cover layer or intermediate layer is consistent throughout the ball.

Golf balls typically exhibit or possess some degree of manufacturing inconsistency. A two-piece, or multi-piece, golf ball typically includes a core that is not exactly and perfectly centered, a cover layer that does not have a uniform thickness or composition, or an intermediate layer that does not have a uniform thickness or composition. Importantly, these manufacturing inconsistencies can negatively affect the performance of the golf ball.

One common attribute of most golf balls with manufacturing inconsistencies or deficiencies is that such balls will have a heavy spot, or heavy side, and a light spot, or light side. When a golf ball is produced from two or more pieces of varying densities, it is likely that the golf ball will have a light and heavy side. Testing has indicated that if a ball is oriented with the heavy side to one side, erratic behavior in flight properties, and in putting accuracy, can result. Generally, the ball will tend to move toward the direction in which the heavy side is oriented. Such a problem is common in most commercially available golf balls, and is detrimental to the golfer. The imbalance exhibited by the heavy and light spots of a golf ball can cause a putt to veer off line or an iron or driver shot to "hook" or "slice" off of its intended path. Additionally, when a ball is unbalanced, it generally fails to follow a true trajectory and its total flight distance is often negatively affected.

Thus, there is a continuing need for a golf ball that is perfectly balanced and won't depart from its intended flight or roll path due to an off-center core or outer layers of inconsistent thickness. What is needed is a golf ball that does not possess a heavy and light side due to manufacturing inconsistencies and, therefore, flies and putts true. It would be advantageous to develop a true, balanced golf ball that can be readily mass-produced. There is also a need for a golf ball having a cover layer and an intermediate layer (if applicable) of uniform density without areas of uneven material distribution.

SUMMARY OF THE INVENTION

The present invention provides a golf ball including a core formed of a first composition, and a cover layer formed of a second composition. The specific gravity values of each of the first and second compositions are generally equal to each other. The first and second compositions are each sufficiently mixed such that the ball exhibits random orientation when floated in a solution of sufficient density to support the ball. The weight, size, spherical symmetry, initial velocity and overall distance of the ball conform to the golf ball requirements of the United States Golf Association, effective Jan. 1, 2002.

According to a principal aspect of the invention, a golf ball includes a core and a cover layer. The core is formed of a high cis-1,4 content polybutadiene, 26 to 32 parts by weight of a co-crosslinking agent, 3 to 5 parts by weight of a metal oxide activator, 0.8 to 1.5 phr of a free-radical initiator, and a first predetermined amount of inorganic fillers sufficient to produce a specific gravity of the core within the range of 1.12 to 1.13. The cover layer is formed of a blend of first and second ionomers, and a second predetermined amount of inorganic fillers sufficient to produce a specific gravity of the cover layer with the range of 1.115 to 1.134. The cover has a hardness of 56 to 63 on a Shore D Hardness Scale, and a thickness of 0.060 to 0.85 inches.

According to another principal aspect of the invention, a golf ball includes a core and a cover layer. The core is formed of a high cis-1,4 content polybutadiene, 24 to 30 parts by weight of a co-crosslinking agent, 3 to 5 parts by weight of a metal oxide activator, 0.8 to 1.5 phr of a free-radical initiator, and a first predetermined amount of inorganic fillers sufficient to produce a specific gravity of the core within the range of 1.12 to 1.13. The cover layer is formed of a blend of first and second ionomers, and a second predetermined amount of inorganic fillers sufficient to produce a specific gravity of the cover layer with the range of 1.115 to 1.134. The cover has a hardness of at least 68 on a Shore D Hardness Scale, and a thickness of 0.0625 to 0.85 inches.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
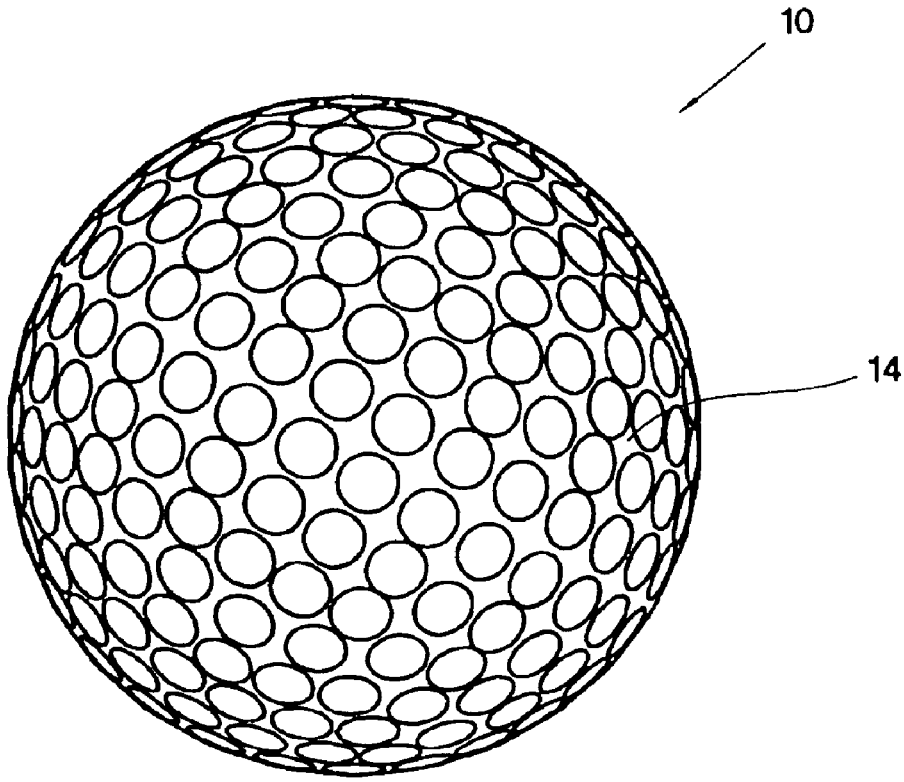
FIG. 1 a front view of a golf ball in accordance with a preferred embodiment of the present invention.
Figure 2:
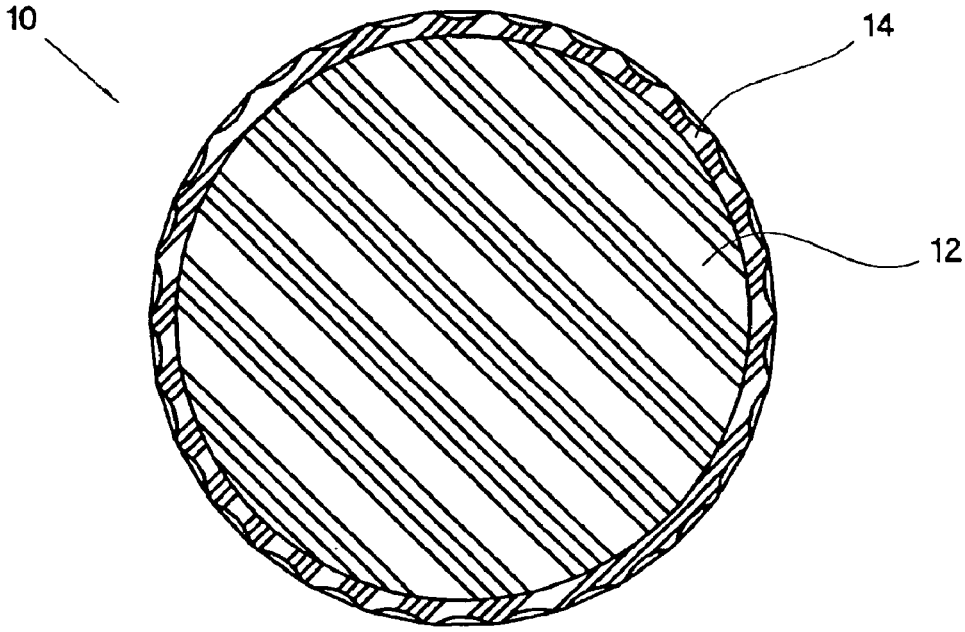
FIG. 2 is a cross-sectional view of the golf ball of FIG. 1.

The present invention relates to an improved two-piece golf ball, and, in particular, a balanced two-piece golf ball. Referring to FIGS. 1–2, a preferred embodiment of a multi-layered golf ball is indicated generally at 10. The ball 10 includes a core 12 and a cover layer 14.

The core 12 is a substantially spherical, generally solid member positioned at the geometric center of the ball 10. The core 12 is formed of a high cis-1,4 content polybutadiene, a co-crosslinking agent, a metal oxide activator, a free-radical initiator, and sufficient amounts of inorganic fillers to produce the desired core specific gravity of 1.12 to 1.13. The co-crosslinking agent improves the stiffness and resiliency of the core. In a preferred embodiment, the core composition includes 26–32 parts by weight of the co-crosslinking agent. In another preferred embodiment, the core composition includes 24–30 parts by weight of the co-crosslinking agent. In a particularly preferred embodiment, the co-crosslinking agent is a zinc salt of an unsaturated acrylate. The zinc salt of an unsaturated acrylate can be approximately 92 percent zinc diacrylate and 8 percent stearate.

The composition of the core also preferably includes 3–5 parts by weight of the metal oxide activator and 0.8–1.5 phr of the free-radical initiator. In a particularly preferred embodiment, the metal oxide activator is a zinc oxide and the free-radical initiator is a peroxide. Preferably, the free-radical initiator is 1,1 Di-(tert-butylperoxy)-3,3,5-trimethylcyclohexane, which is available from Akzo Nobel under the tradename Triganox® 29/40. In addition to serving as an activator, zinc oxide also enables the composition of the core 12 to cure faster thereby reducing the manufacturing time of the core 12. In alternative embodiments, other amounts of one or more of the cross-linking agent, the metal oxide activator and the free-radical initiators can be used. Additionally, alternative cross-linking agents, metal oxide activators and free-radical initiators can also be used.

In a preferred embodiment, the inorganic fillers used in the core 12 are comprised of zinc oxide, barium sulfate or a combination thereof. The total amount of the inorganic fillers to produce a core specific gravity of 1.12 to 1.13 is within the range of 10 to 14 phr. In a particularly preferred embodiment, 11 to 13 phr of the inorganic fillers are used to produce a core composition of the desired specific gravity.

The composition of the core 12 is mixed, molded and then glebarred to a desired diameter. In a preferred embodiment, the core 12 has an outside diameter within the range 1.53 to 1.56 inches, and a deflection of between 0.105 and 0.120 inches under an applied load of 200 lbs. In another preferred embodiment, the core 12 has an outside diameter within the range 1.53 to 1.55 inches, and a deflection of between 0.128 and 0.140 inches under an applied load of 200 lbs. The core 12 can also be formed in other sizes and can have a compression or deflection value outside of 0.105 and 0.120 inches, or 0.128 and 0.140 inches, under an applied load of 200 lbs.

The cover layer 14 is a spherical covering that encompasses the core 12. The cover layer 14 is molded about the core 12. Preferably, the cover layer 14 is formed into half shells, and then compression molded about the core 12. In one particularly preferred embodiment, the balls 10 are be molded using an Engel Injection Press and an eight cavity golf ball mold.

The cover layer 14 is formed of a blend of two or more ionomers, and sufficient amounts of inorganic fillers to produce the desired core specific gravity of 1.15 to 1.134. In one preferred embodiment, the two or more ionomers include a copolymer, such as, for example, Surlyn® 8140 produced by DuPont@, and a terpolymer, such as, for example, Surlyn® 6320 or Surlyn® 6120, each produced by DuPont@. Other ionomers can also be used, such as, for example, one of the ionomers can include 80.5 to 81.5 percent ethylene and 18.5 to 19.5 percent methacrylic acid, and another of the ionomers can include 67–70 percent ethylene, 20–23 percent butyl acrylate, and 9–11 percent methacrylic acid.

In a preferred embodiment, the inorganic fillers used in the cover layer 14 are comprised of barium sulfate, titanium dioxide, or a combination thereof. The total amount of the inorganic fillers to produce a cover layer specific gravity of 1.115 to 1.134 is within the range of 17 to 27 phr. In a particularly preferred embodiment, 19 to 25 phr of the inorganic fillers are used to produce a cover layer composition of the desired specific gravity. In one preferred embodiment, the composition of the cover layer 14 includes at least 21 parts by weight of inorganic fillers per 100 parts by weight of the cover layer composition. Barium sulfate and titanium dioxide are generally white and, therefore, advantageously whiten the composition of the cover layer 14. The use of the white colored fillers can substantially reduce or eliminate the need to apply a primer coat or an outer coat to whiten the outer surface of the ball 10. In a preferred embodiment, the cover layer is coated with a clear coat of paint. In alternative embodiments, other fillers can be used, such as, for example, zinc oxide.

The fillers of the cover layer 14 are thoroughly mixed to ensure even distribution. In a preferred embodiment, the composition of the cover layer 14 is compounded using compounding equipment, such as, for example, a twin screw extruder or other compounding machine. The compounding equipment, such as the twin screw extruder, produce a homogenous cover layer 14 having substantially uniform material distribution. The uniformly mixed and evenly distributed cover layer 14 contributes to the production of a balanced golf ball. Simply adding material into an injection press barrel results in insufficient mixing to produce a homogeneous specific gravity. The variability of a material that is simply added into an injection press barrel often is large enough to cause an "imbalance" in the ball when tested. However, material compounded with a twin screw extruder typically does have sufficient mixing and low variability to produce a homogeneous specific gravity.

The cover layer 14 is formed to a desired thickness and hardness. In a preferred embodiment, the cover layer 14 has thickness within the range 0.060 to 0.085 inches, and a hardness within the range of 56 to 63 on the Shore D hardness scale. In another preferred embodiment, the cover layer 14 has thickness within the range 0.0625 to 0.085 inches, and a hardness within the range of at least 68 on the Shore D hardness scale. The cover layer 14 can also be formed in other sizes and with a hardness outside of the range of 56 to 63, or below 68, on the Shore D hardness scale.

The core 12 and the cover layer 14 combine to produce the ball 10 which has a weight of between 45.0 and 45.93 grams, a deflection of within the range 0.090 and 0.105 inches under an applied load of 200 lb., and a density sufficiently homogeneous to ensure random orientation when "floated" in a solution of sufficient density to support the ball. Preferably, the specific gravity values of the two component parts of the ball (the core and cover layer) are within 0.005 of each other. In alternative preferred embodiments, the core and cover layer of the ball can be formed of compositions having different, but substantially equivalent, specific gravity values.

The ball of the present invention putts and flies truer upon impact than unbalanced balls. By maintaining the specific gravity of the core and the cover layer substantially equal, and by ensuring proper homogenous mixing of the component parts of the cover layer, the ball of the present invention also exhibits a random orientation when "floated" in a solution of sufficient density to support the ball. In other words, the ball of the present invention is balanced and does not include heavy or light spots that can negatively affect the performance of the ball. The configuration of the ball enables the ball to be balanced even if the core or the cover layer include minor manufacturing inconsistencies, in their shape, orientation or thickness. Thus, the balanced ball of the present invention can be readily mass-produced while maintaining true and consistent ball performance characteristics.

The "float" test referred to above can be performed in the following manner. First a container, preferably a transparent or semi-transparent container, is substantially filled with warm water. A salt, such as Epsom Salt, is then added to the solution in a sufficient amount to enable one or more golf balls to float in the solution. A desired range for the specific gravity of the solution is about 1.14 to 1.20. Best results are obtained when a lubricant, such as a detergent, is added to the salt water solution to reduce friction between the outer surface of the golf ball and the solution. In a particularly preferred method, a few drops of Jet Dry detergent are added to the solution. A golf ball is then placed into the solution and spun. When the ball stops spinning the upper most portion of the ball is marked with a marker or otherwise identified. The ball is then spun again in the solution and the upper most portion of the ball is again marked or identified. The ball can then be spun additional times to obtain additional results.

An unbalanced ball will generally have a light spot and a heavy spot. When an unbalanced ball is repeatedly spun in the salt water solution of the float test described above, the ball will tend to consistently orient itself in the solution with its light spot up and its heavy spot down. In contrast, a balanced golf ball will exhibit a random orientation when "floated" in a solution of sufficient density to support the ball. The random orientation in the test solution is indicative of the absence of a light or heavy spot within the balanced golf ball.

The ball 10 also fully conforms to the United States Golf Association® ("USGA®") requirements for golf balls specified in the USGA®, "The Rules of Golf And The Rules Of Amateur Status 2002–2003", effective Jan. 1, 2002, which is incorporated by reference. Appendix III of the USGA® Rules of Golf includes the following ball requirements:

1. Weight

The weight of the ball shall not to be greater than 1.620 ounces avoirdupois (45.93 gm).

2. Size

The diameter of the ball shall not be less than 1.680 inches (42.67 mm). This specification will be satisfied if, under its own weight, a ball falls through a 1.680 inches diameter ring gauge in fewer than 25 out of 100 randomly selected positions, the test being carried out at a temperature of 23+/−1 degree C.

3. Spherical Symmetry

The ball must not be designed, manufactured or intentionally modified to have properties which differ from those of a spherically symmetrical ball.

4. Initial Velocity

The initial velocity of the ball shall not exceed the limit specified (test on file) [250 ft/s+2%, or 255 ft/s] when measured on apparatus approved by the United States Golf Association.

5. Overall Distance Standard

The combined carry and roll of the ball, when tested on apparatus approved by the United States Golf Association, shall not exceed the distance specified under the conditions set forth in the Overall Distance Standard for golf balls on file with the United States Golf Association.

The present invention is further illustrated by the following examples. The present invention is not limited to the following examples, and various changes and modifications may be made in the invention without departing from the spirit and scope thereof.

EXAMPLE 1

The Example 1 golf balls were designed and produced in accordance with the present invention. The Example 1 balls were made with the following core composition. "Phr" refers to number of parts by weight per 100 parts by weight of rubber.

Core Formula:

| Material | Phr |
|---|---|
| Enichem BR-40 Polybutadiene | 97.5 |
| Adiprene FM Polyurethane Rubber | 2.5 |
| SR416D Zinc Diacrylate | 29 |
| Zinc Oxide | 5 |
| Zinc Stearate | 3 |
| Triganox 29/40 | 2.05 |
| Barytes | 6.4 |

The core of each Example 1 ball was mixed and molded to this formulation, and glebarred to 1.54" diameter. After centerless grinding or glebarring, the cores had a size of 1.54", a weight of 35.25 g, a deflection of 0.113" under an applied load of 200 lb., and a specific gravity of 1.125.

The cover layers for the ball of Example 1 were made using a blend of about 35% by weight Surlyn® 8140, which is a copolymer produced by DuPont® containing ~81% ethylene and ~19% methacrylic acid, wherein ~50% of the carboxylic acid groups are neutralized with sodium ions, and about 65% by weight Surlyn® 6320, which is a terpolymer produced by DuPont® of ~70% ethylene, ~20% n-butyl acrylate, and ~10% methacrylic acid, wherein the acid groups are ~70% neutralized with magnesium ions. The Surlyn blend described was compounded with titanium dioxide, barium sulfate and color concentrate to produce a material with a homogeneous specific gravity of about 1.125, and a blue-white color which allow for clear coat painting of the final golf ball product. The balls were molded using an Engel injection press and an 8 cavity golf ball mold.

The balls of Example 1 were then tested for physical properties against competitive products. Table 1 lists the results of the physical properties test.

TABLE 1

Physical Properties:

| Ball | Size | Defl. | Weight | Shore 'D' | Coefficient Of Restitution 125 f/s | 150 f/s | 175 f/s | I.V. |
|---|---|---|---|---|---|---|---|---|
| Example 1 | 1.6823" | 0.1034" | 45.43 | 58 | 0.790 | 0.762 | 0.736 | 254.9 |
| Titleist Pro V1 | 1.6797" | 0.0969" | 45.58 | 59 | 0.795 | 0.765 | 0.737 | 254.3 |
| Titleist NXT Tour | 1.6807" | 0.1073" | 45.42 | 61 | 0.810 | 0.778 | 0.747 | 256.1 |
| Precept Tour Premium | 1.6802" | 0.0975" | 45.23 | 52 | 0.789 | 0.763 | 0.730 | 254.3 |
| Nike Tour Accuracy | 1.6814" | 0.0965" | 45.51 | 51 | 0.787 | 0.758 | 0.726 | 253.8 |
| Nike Tour Accuracy TW | 1.6809" | 0.0890" | 45.15 | 56 | 0.792 | 0.764 | 0.730 | 254.0 |
| Callaway Rule 35 SoftFeel | 1.6798" | 0.0894" | 45.40 | 56 | 0.784 | 0.758 | 0.726 | 252.7 |
| Maxfli A10 | 1.6825" | 0.1002" | 45.78 | 58 | 0.786 | 0.767 | 0.745 | 256.1 |
| Strata Tour Ultimate | 1.6829" | 0.0917" | 45.47 | 52 | 0.799 | 0.769 | 0.741 | 254.4 |

Hardness measurements were measured using a durometer in the Shore D scale manufactured by Shore Instruments. Hardness readings were taken at the surface of the ball. Deflection measurement were taken under a 200 lb. applied load, using Wilson Dead Weight Deflection testing machine.

"C.O.R. (125 ft/s)" refers to the ratio of outbound/inbound velocity with a 125 ft/s inbound velocity test setup. "C.O.R. (150 ft/s)" refers to the ratio of outbound/inbound velocity with a 150 ft/s inbound velocity test setup. "C.O.R. (175 ft/s)" refers to the ratio of outbound/inbound velocity with a 175 ft/s inbound velocity test setup. "Initial Velocity" was measured using the Wilson Initial Velocity Test Machine.

The golf ball of Example 1 yields comparable initial velocity, compression, C.O.R., etc. properties compared to competitive set tested.

TABLE 2

Flight Performance Properties:

| Ball | Carry Dist. | Total Dist. | Apogee | I.V. | Driver Spin | 9-I Spin |
|---|---|---|---|---|---|---|
| Example 1 | 243.1 | 247.6 | 10.6 | 231.7 | 3231 | 8105 |
| Titleist Pro V1 | 243.4 | 248.3 | 10.7 | 232.4 | 3376 | 7922 |
| Titleist NXT Tour | 245.0 | 252.1 | 10.4 | 232.2 | 3125 | 8264 |
| Precept Tour Premium | 238.4 | 247.8 | 10.0 | 231.0 | 3506 | 8423 |
| Nike Tour Accuracy | 238.7 | 245.6 | 10.0 | 230.4 | 3501 | 8461 |
| Nike Tour Accuracy TW | 241.9 | 249.7 | 10.1 | 232.4 | 3467 | 8261 |
| Callaway Rule 35 | 243.4 | 250.2 | 10.5 | 231.4 | 3480 | 7971 |

TABLE 2-continued

Flight Performance Properties:

| Ball | Carry Dist. | Total Dist. | Apogee | I.V. | Driver Spin | 9-I Spin |
|---|---|---|---|---|---|---|
| SoftFeel | | | | | | |
| Maxfli A10 | 242.6 | 249.0 | 10.2 | 232.5 | 3508 | 8481 |
| Strata Tour Ultimate | 241.7 | 248.5 | 10.3 | 232.7 | 3448 | 8125 |

The tests involving a driver and 9-iron were performed using a True Temper machine. The driver test results illustrated are an average of 4 tests wherein the clubhead velocity was 230 ft/sec and the launch angle was 10.5°. The 9-iron test results illustrated are an average of 2 tests wherein the clubhead velocity was 150 ft/sec and the launch angle was 25°.

The golf ball of Example 1 yields exceptional flight and spin properties compared to the competitive set. Distance, Spin rate (both Driver and 9-iron), and initial velocity properties are all comparable to or better than the majority of the competitive set.

A Putting Accuracy Test was also performed, at Wilson Golf Research Testing Facility, on the Example 1 balls under the following Test Set-Up and Test Design.

Test Set-up—The evaluation is performed by putting the balls with a pendulum style putting apparatus configured with a standard putter on a table sloped uphill at 1.0° and level from side to side. The surface of the table is overlaid with 21 oz. felt. A standard USGA regulation cup (4¼ inch in diameter) is sunk in the surface on the intended putting line and allows for an approximate 10 foot putt.

Test Design—Each golf ball in each dozen was putted 12 times. The test included two parts (6 putts per part):

(1) Each ball was oriented 3 times with the light spot LEFT and putted, and 3 times with the light spot RIGHT and putted.

(2) Each ball was randomly oriented and putted 6 times.

The testing was conducted in 6 rounds. Each round of testing constituted a dozen of each of the 28 ball types being putted. The ball types were putted one dozen at a time and pulled in random order during a given round. In all, a total of 24,192 putts were recorded.

TABLE 3

Putting Accuracy Test Results:

| | Bridge-stone Tour Stage U-Drive | Bridge-stone Tour Stage AMZ | Callaway CB1 Red | Callaway CTU 30 Blue | Callaway CTU 30 Red | Callaway CB1 Blue | Dunlop New Breed Pro Wound | Dunlop XX10 Tour Special | Kasco Silicone Power | Maxfli A10 | Maxfli Hi-Brid | Maxfli Noodle | Nike Power Distance |
|---|---|---|---|---|---|---|---|---|---|---|---|---|---|
| # of Dzn Tested | 6 | 6 | 6 | 6 | 6 | 6 | 6 | 6 | 6 | 6 | 6 | 6 | 6 |
| Oriented Missing Correctly (432 putts) | 30 | 66 | 115 | 43 | 20 | 186 | 265 | 97 | 68 | 42 | 82 | 45 | 92 |
| Oriented No. of Balls Missing 2X Correctly | 8 | 18 | 32 | 12 | 4 | 51 | 65 | 28 | 20 | 9 | 23 | 9 | 26 |
| Oriented No. of Balls Missing 3X Correctly | 3 | 9 | 21 | 4 | 2 | 37 | 56 | 12 | 7 | 3 | 14 | 3 | 12 |
| Oriented No. of Balls Missing 4X Correctly | 0 | 2 | 7 | 1 | 0 | 23 | 38 | 7 | 2 | 0 | 2 | 1 | 4 |
| Oriented No. of Balls Missing 5X Correctly | 0 | 0 | 2 | 0 | 0 | 10 | 27 | 2 | 0 | 0 | 2 | 0 | 3 |
| Oriented No. of Balls Missing 6X Correctly | 0 | 0 | 0 | 0 | 0 | 3 | 12 | 2 | 0 | 0 | 2 | 0 | 0 |

| | Nike Tour Accu-racy | Nike Tour Accu-racy TW | Precept Extra Spin | Precept MC Lady | Precept Tour Premium LS | Srixon Hi-Spin | Strata Tour Ultimate I | Strata Tour Ultimate II | Titleist NXT Distance | Titleist NXT Tour | Titleist Pro VI | Titleist Tour Distance SF | Exam-ple 1 |
|---|---|---|---|---|---|---|---|---|---|---|---|---|---|
| # of Dzn Tested | 6 | 6 | 6 | 6 | 6 | 6 | 6 | 6 | 6 | 6 | 6 | 6 | 6 |
| Oriented Missing Correctly (432 putts) | 35 | 32 | 28 | 22 | 16 | 46 | 101 | 111 | 62 | 31 | 28 | 293 | 13 |
| Oriented No. of Balls Missing 2X Correctly | 8 | 4 | 7 | 6 | 2 | 12 | 30 | 30 | 19 | 3 | 6 | 66 | 1 |
| Oriented No. of Balls Missing 3X Correctly | 5 | 0 | 2 | 0 | 0 | 3 | 12 | 17 | 2 | 1 | 2 | 61 | 0 |
| Oriented No. of Balls Missing 4X Correctly | 0 | 0 | 0 | 0 | 0 | 1 | 6 | 6 | 1 | 0 | 0 | 47 | 0 |
| Oriented No. of Balls Missing 5X Correctly | 0 | 0 | 0 | 0 | 0 | 0 | 4 | 1 | 1 | 0 | 0 | 34 | 0 |
| Oriented No. of Balls Missing 6X Correctly | 0 | 0 | 0 | 0 | 0 | 0 | 1 | 0 | 0 | 0 | 0 | 16 | 0 |

The data illustrates that the ball of Example 1 performs the best among all balls in the category of "Correct Oriented Misses." "Correct Oriented Misses" means that balls putted with their heavy spot oriented to the right (and the light spot oriented to the left) missed the cup right, and vice versa if the heavy spot was oriented to the left. The ball of Example 1 missed 13 of 432 putts, which outperformed every other competitive ball in putting accuracy as evaluated in this test.

EXAMPLE 2

The Example 2 golf balls were designed and produced in accordance with the present invention. The Example 2 balls were made with the following core composition. "Phr" refers to number of parts by weight per 100 parts by weight of rubber.

Core Formula:

| Material | Phr |
|---|---|
| Enichem BR-40 Polybutadiene | 97.5 |
| Adiprene FM Polyurethane Rubber | 2.5 |
| SR416D Zinc Diacrylate | 24.75 |
| Zinc Oxide | 5 |
| Zinc Stearate | 3 |
| Triganox 29/40 | 2.05 |
| Barytes | 8.6 |

The core of each Example 2 ball was mixed and molded to this formulation, and glebarred to 1.54" diameter. After centerless grinding or glebarring, the cores had a size of 1.54", a weight of 35.22 g, a deflection of 0.135" under an applied load of 200 lb., and a specific gravity of 1.124.

The cover layers for the ball of Example 2 were made using a blend of about 60% by weight Surlyn® 8140 containing [18] 81% ethylene and ~19% methacrylic acid, wherein ~50% of the carboxylic acid groups are neutralized with sodium ions, and about 40% by weight Surlyn® 6120, which is a terpolymer produced by DuPont® of ~81% ethylene and ~19% methacrylic acid, wherein the acid groups are ~50% neutralized with magnesium ions. The Surlyn® blend described was compounded with titanium dioxide, barium sulfate and color concentrate to produce a material with a homogeneous specific gravity of about 1.125, and a blue-white color which allow for clear coat painting of the final golf ball product. The balls were molded using an Engel injection press and an 8 cavity golf ball mold.

The balls of Example 2 were then tested for physical properties against competitive products. Table 1 lists the results of the physical properties test.

TABLE 1

Physical Properties:

| Ball | Size | Defl. | Weight | Shore 'D' | Coefficient Of Restitution 125 f/s | 150 f/s | 175 f/s | I.V. |
|---|---|---|---|---|---|---|---|---|
| Example 2 | 1.6846" | 0.0948" | 45.65 | 71 | 0.824 | 0.796 | 0.767 | 258.1 |
| Bridgestone BIIM | 1.6819" | 0.0898" | 45.24 | 69 | 0.811 | 0.785 | 0.754 | 256.7 |
| Bridgestone Tourstage AMZ | 1.6811" | 0.1079" | 45.24 | 70 | 0.806 | 0.778 | 0.746 | 255.5 |
| Dunlop Hi-Brid | 1.6842" | 0.1023" | 45.24 | 70 | 0.805 | 0.779 | 0.749 | 255.9 |
| Dunlop XX10 Tour Special | 1.6827" | 0.0948" | 45.49 | 69 | 0.806 | 0.779 | 0.750 | 255.6 |
| Dunlop XX10 Hard Spec. | 1.6813" | 0.0888" | 45.37 | 70 | 0.807 | 0.784 | 0.758 | 256.7 |
| Kasco Power Tornado | 1.6830" | 0.1084" | 45.50 | 70 | 0.814 | 0.786 | 0.751 | 257.7 |
| Kasco Rockets Type S | 1.6821" | 0.0916" | 45.47 | 67 | 0.808 | 0.780 | 0.751 | 255.6 |

Hardness measurements were measured using a durometer in the Shore D scale manufactured by Shore Instruments. Hardness readings were taken at the surface of the ball. Deflection measurement were taken under a 200 lb. applied load, using Wilson Dead Weight Deflection testing machine.

"C.O.R. (125 ft/s)" refers to the ratio of outbound/inbound velocity with a 125 ft/s inbound velocity test setup. "C.O.R. (150 ft/s)" refers to the ratio of outbound/inbound velocity with a 150 ft/s inbound velocity test setup. "C.O.R. (175 ft/s)" refers to the ratio of outbound/inbound velocity with a 175 ft/s inbound velocity test setup. "Initial Velocity" was measured using the Wilson Initial Velocity Test Machine.

The golf ball of Example 2 yields higher initial velocity and C.O.R. properties compared to the competitive set. Deflection and cover hardness is comparable to the competitive set tested.

TABLE 2

Flight Performance Properties:

| Ball | Carry Dist. | Total Dist. | Apogee | I.V. | Driver Spin | 9-I Spin |
|---|---|---|---|---|---|---|
| Example 2 | 263.9 | 276.4 | 11.0 | 231.1 | 2548 | 6955 |
| Bridgestone BIIM | 261.5 | 273.0 | 11.0 | 229.8 | 2781 | 7831 |
| Bridgestone Tourstage AMZ | 260.0 | 275.0 | 11.0 | 228.3 | 2605 | 7660 |
| Dunlop Hi-Brid | 261.3 | 271.6 | 11.1 | 230.6 | 2769 | 7756 |
| Dunlop XX10 Tour Special | 260.0 | 273.1 | 11.1 | 229.7 | 2672 | 7788 |
| Dunlop XX10 Hard Spec. | 259.4 | 270.9 | 11.0 | 230.7 | 2624 | 7596 |
| Kasco Power Tornado | 263.2 | 273.2 | 11.1 | 229.6 | 2660 | 7831 |
| Kasco Rockets Type S | 253.8 | 271.2 | 10.8 | 229.6 | 2682 | 7863 |
| Strata Tour Ultimate | 241.7 | 248.5 | 10.3 | 232.7 | 3448 | 8125 |

The tests involving a driver and 9-iron were performed using a True Temper machine. The driver test results illustrated are an average of 3 tests wherein the clubhead velocity was 230 ft/sec and the launch angle was 10.5°. The 9-iron test results illustrated are a result of 1 test wherein the clubhead velocity was 150 ft/sec and the launch angle was 25°.

The golf ball of Example 2 yields flight and spin properties which are comparable to the competitive set. Distance and initial velocity properties of the golf ball of Example 2 exceed those of the competitive balls, and spin rates are comparable to the range produced by the competitive set.

A Putting Accuracy Test was also performed, at Wilson Golf Research Testing Facility, on the Example 1 balls under the following Test Set-Up and Test Design.

Test Set-up—The evaluation is performed by putting the balls with a pendulum style putting apparatus configured with a standard putter on a table sloped uphill at 1.0° and level from side to side. The surface of the table is overlaid with 21 oz. felt. A standard USGA regulation cup (4¼ inch in diameter) is sunk in the surface on the intended putting line and allows for an approximate 10' putt.

Test Design—Each golf ball in each dozen was putted 12 times. The test included two parts (6 putts per part):

(1) Each ball was oriented 3 times with the light spot LEFT and putted, and 3 times with the light spot RIGHT and putted.

(2) Each ball was randomly oriented and putted 6 times.

The testing was conducted in 6 rounds. Each round of testing constituted a dozen of each of the 28 ball types being putted. The ball types were putted one dozen at a time and pulled in random order during a given round. In all, a total of 24,192 putts were recorded.

TABLE 3

Putting Accuracy Test Results:

| | Bridgestone Tour Stage U-Drive | Bridgestone Tour Stage AMZ | Callaway CB1 Red | Callaway CTU 30 Blue | Callaway CTU 30 Red | Callaway CB1 Blue | Dunlop New Breed Pro Wound | Dunlop XX10 Tour Special | Kasco Silicone Power | Maxfli A10 | Maxfli Hi-Brid | Maxfli Noodle | Nike Power Distance |
|---|---|---|---|---|---|---|---|---|---|---|---|---|---|
| # of Dzn Tested | 6 | 6 | 6 | 6 | 6 | 6 | 6 | 6 | 6 | 6 | 6 | 6 | 6 |
| Oriented Missing Correctly (432 putts) | 30 | 66 | 115 | 43 | 20 | 186 | 265 | 97 | 68 | 42 | 82 | 45 | 92 |
| Oriented No. of Balls Missing 2X Correctly | 8 | 18 | 32 | 12 | 4 | 51 | 65 | 28 | 20 | 9 | 23 | 9 | 26 |
| Oriented No. of Balls Missing 3X Correctly | 3 | 9 | 21 | 4 | 2 | 37 | 56 | 12 | 7 | 3 | 14 | 3 | 12 |
| Oriented No. of Balls Missing 4X Correctly | 0 | 2 | 7 | 1 | 0 | 23 | 38 | 7 | 2 | 0 | 2 | 1 | 4 |
| Oriented No. of Balls Missing 5X Correctly | 0 | 0 | 2 | 0 | 0 | 10 | 27 | 2 | 0 | 0 | 2 | 0 | 3 |
| Oriented No. of Balls Missing 6X Correctly | 0 | 0 | 0 | 0 | 0 | 3 | 12 | 2 | 0 | 0 | 2 | 0 | 0 |

| | Nike Tour Accuracy | Nike Tour Accuracy TW | Precept Extra Spin | Precept MC Lady | Precept Tour Premium LS | Srixon Hi-Spin | Strata Tour Ultimate I | Strata Tour Ultimate II | Titleist NXT Distance | Titleist NXT Tour | Titleist Pro VI | Titleist Tour Distance SF | Example 2 |
|---|---|---|---|---|---|---|---|---|---|---|---|---|---|
| # of Dzn Tested | 6 | 6 | 6 | 6 | 6 | 6 | 6 | 6 | 6 | 6 | 6 | 6 | 6 |
| Oriented Missing Correctly (432 putts) | 35 | 32 | 28 | 22 | 16 | 46 | 101 | 111 | 62 | 31 | 28 | 293 | 4 |
| Oriented No. of Balls Missing 2X Correctly | 8 | 4 | 7 | 6 | 2 | 12 | 30 | 30 | 19 | 3 | 6 | 66 | 1 |
| Oriented No. of Balls Missing 3X Correctly | 5 | 0 | 2 | 0 | 0 | 3 | 12 | 17 | 2 | 1 | 2 | 61 | 0 |
| Oriented No. of Balls Missing 4X Correctly | 0 | 0 | 0 | 0 | 0 | 1 | 6 | 6 | 1 | 0 | 0 | 47 | 0 |
| Oriented No. of Balls Missing 5X Correctly | 0 | 0 | 0 | 0 | 0 | 0 | 4 | 1 | 1 | 0 | 0 | 34 | 0 |
| Oriented No. of Balls Missing 6X Correctly | 0 | 0 | 0 | 0 | 0 | 0 | 1 | 0 | 0 | 0 | 0 | 16 | 0 |

The data illustrates that the ball of Example 1 performs the best among all balls in the category of "Correct Oriented Misses." "Correct Oriented Misses" means that balls putted with their heavy spot oriented to the right (and the light spot oriented to the left) missed the cup right, and vice versa if the heavy spot was oriented to the left. The ball of Example 1 missed 4 of 432 putts, which outperformed every other competitive ball in putting accuracy as evaluated in this test.

The results of the Putting Accuracy and the Flight Performance Tests from Example 1 and Example 2 demonstrate that the balls of Example 1 and 2 are vastly superior to tested competitive balls in putting accuracy. Further, the balls of Example 1 and Example 2 also have exceptional performance characteristics that were comparable to the performance characteristics of competitive balls tested.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A golf ball comprising:

a core formed of a high cis-1,4 content polybutadiene, 26 to 32 parts by weight of a co-crosslinking agent, 3 to 5 parts by weight of a metal oxide activator, 0.8 to 1.5 phr of a free-radical initiator, and a first predetermined amount of inorganic fillers sufficient to produce a specific gravity of the core within the range of 1.12 to 1.13; and a cover layer formed of a blend of at least first and second ionomers, and a second predetermined amount of inorganic fillers sufficient to produce a specific gravity of the cover layer with the range of 1.115 to 1.134, the cover having a hardness of 56 to 63 on a Shore D Hardness Scale, and a thickness of 0.060 to 0.85 inches, the ball having a weight of between 45.0 and 45.93 grams, and the ball having a deflection within a range of 0.090 and 0.105 inches under an applied load of 200 lbs.

2. The golf ball of claim 1, wherein the compositions of the core and the cover layer are each mixed sufficiently to ensure random orientation of the ball when the ball is floated in a solution of sufficient density to support the ball.

3. A golf ball comprising:

a core formed of a high cis-1,4 content polybutadiene, 24 to 30 parts by weight of a co-crosslinking agent, 3 to 5 parts by weight of a metal oxide activator, 0.8 to 1.5 phr of a free-radical initiator, and a first predetermined amount of inorganic fillers sufficient to produce a specific gravity of the core within the range of 1.12 to 1.13; and a cover layer formed of a blend of at least first and second ionomers, and a second predetermined amount of inorganic fillers sufficient to produce a specific gravity of the cover layer with the range of 1.115 to 1.134, the cover having a hardness of at least 68 on a Shore D Hardness Scale, and a thickness of 0.0625 to 0.85 inches, the ball having a weight of between 45.0 and 45.93 grams, and the ball having a deflection within a range of 0.090 and 0.105 inches under an applied load of 200 lbs.

4. The golf ball of claim 3, wherein the compositions of the core and the cover layer are each mixed sufficiently to ensure random orientation of the ball when the ball is floated in a solution of sufficient density to support the ball.

* * * * *